United States Patent [19]

Embree et al.

[11] Patent Number: 4,588,940

[45] Date of Patent: May 13, 1986

[54] TEMPERATURE COMPENSATED SEMICONDUCTOR INTEGRATED CIRCUIT

[75] Inventors: Milton L. Embree, Reading; Elizabeth E. Perry, Wyomissing, both of Pa.

[73] Assignee: AT&T Bell Laboratories, Murray Hill, N.J.

[21] Appl. No.: 564,703

[22] Filed: Dec. 23, 1983

[51] Int. Cl.[4] ..... G05F 3/22

[52] U.S. Cl. ..... 323/313; 307/310; 323/907

[58] Field of Search ..... 307/310; 323/312, 313, 323/314, 907

[56] References Cited

U.S. PATENT DOCUMENTS

| | | | |
|---|---|---|---|
| 3,588,535 | 6/1971 | Hellstrom | 323/907 |
| 3,908,162 | 9/1975 | Marley et al. | 323/313 |
| 3,970,876 | 7/1976 | Allen et al. | 307/310 |
| 4,079,308 | 3/1978 | Brown | 323/314 |
| 4,091,321 | 5/1978 | Hanna | 323/314 |
| 4,099,115 | 7/1978 | Watanabe | 323/907 |
| 4,100,477 | 7/1978 | Tam | 323/314 |
| 4,207,538 | 6/1980 | Goel | 330/277 |
| 4,240,024 | 12/1980 | Blackburn | 323/312 |
| 4,243,948 | 1/1981 | Schade | 323/907 |
| 4,249,122 | 2/1981 | Widlar | 323/313 |
| 4,282,477 | 8/1981 | Ahmed | 323/312 |
| 4,319,180 | 3/1982 | Nagano | 323/313 |
| 4,347,476 | 8/1982 | Tam | 323/313 |
| 4,349,778 | 9/1982 | Davis | 323/314 |
| 4,352,056 | 9/1982 | Cave et al. | 323/907 |
| 4,460,865 | 7/1984 | Bynum et al. | 323/907 |

OTHER PUBLICATIONS

IBM Technical Disclosure Bulletin, vol. 14, No. 4 Sep. 1971.

*Primary Examiner*—Peter S. Wong
*Assistant Examiner*—Jeffrey Sterrett
*Attorney, Agent, or Firm*—Wendy W. Koba

[57] ABSTRACT

The present invention relates to a circuit capable of providing a negative temperature coefficient greater than that provided by discrete silicon integrated circuit components. A constant current source and a resistor divider network are added to a bipolar junction transistor, where the resistors and the constant current source function to increase the negative temperature coefficient of a bipolar junction transistor. The negative temperature compensation circuit formed in accordance with the present invention provides a sufficient negative temperature coefficient to offset the large positive temperature coefficient associated with high voltage avalanche breakdown diodes without requiring a high voltage integrated circuit.

11 Claims, 3 Drawing Figures

TEMPERATURE COMPENSATED SEMICONDUCTOR INTEGRATED CIRCUIT

BACKGROUND OF THE INVENTION

1. Field of the Invention

The present invention relates to a silicon integrated circuit for providing a temperature compensated voltage regulator and, more particularly, to an enhanced normalized temperature coefficient voltage regulator.

2. Description of the Prior Art

In many electronic circuits, a high negative temperature coefficient voltage regulator diode is needed. For example, in a high voltage protection circuit, an avalanche diode is often used in the trigger circuit of a silicon controlled rectifier (SCR). The large positive temperature coefficient of avalanche diodes results in the trigger voltage of the protection circuit having a large positive temperature coefficient. In addition to the temperature coefficient problem, there is a large variability in the trigger current of large SCRs which, when coupled with the relatively large series resistance of avalanche diodes, leads to a significant variability of the protection circuit trigger voltage.

A wide variety of temperature compensation circuits exist in the prior art, one exemplary arrangement disclosed in U.S. Pat. No. 4,207,538 issued to J. Goel on June 10, 1980. In the Goel arrangement, a positive temperature coefficient resistance element such as a sensitor and a negative coefficient resistance element such as a thermistor are arranged in a potential divider network, the output terminal of which produces a potential which is a function of temperature. The potential is applied as a bias potential to the control electrode of an amplifier circuit subject to variations in gain as a function of both control electrode voltage and temperature. The potential divider network, therefore, functions to reduce the gain of the amplifier, as a function of temperature.

An alternative arrangement is disclosed in U.S. Pat. No. 4,282,477 issued to A. A. A. Ahmed on Aug. 4, 1981. Here, emitter-coupled differential amplifier transistors have their collector currents differentially combined for application to a series regulator transistor in series with a potential divider network having first and second taps to the base electrodes of the emitter-coupled differential amplifier transistors, for completing a feedback loop which develops positive-temperature-coefficient voltages across resistor portions of the potential divider network. These positive-temperature-coefficient voltages augment negative-temperature-coefficient voltages developed across semiconductor diode means included in the potential divider network to provide for zero-temperature-coefficient voltages being developed across the potential divider network or a portion thereof.

U.S. Pat. No. 4,100,477 issued to R. K. Tam on July 11, 1978 discloses yet another arrangement related to a fully regulated temperature compensated voltage regulator. In the Tam arrangement, the compensation is achieved by the provision of a supply feedback amplifier, coupled to a voltage regulator whose resistances carefully match the resistances of the regulator so that fluctuation in the supply voltage is sensed by the supply feedback section which is dependent only on such matching. This matching provides matching current flow in the regulator and feedback corresponding to variations in current so that current flow through the shunt transistor of the regulator is constant.

There remains in the prior art, the problem of obtaining an enhanced normalized temperature coefficient. A simple temperature coefficient of voltage is normally expressed in units of volts per degree or millivolts per degree while a normalized temperature coefficient is usually expressed as parts per million per degree or percent per degree. An enhanced normalized temperature coefficient is one which is greater than the inherent normalized temperature coefficient of the devices from which it is created. Since no very high temperature coefficient components are available in silicon integrated circuit technology, a special circuit is needed to achieve an enhanced normalized voltage temperature coefficient.

SUMMARY OF THE INVENTION

The present invention relates to a silicon integrated circuit for providing a temperature compensator voltage regulator and, more particularly, to an enhanced normalized temperature coefficient voltage regulator formed with bipolar silicon integrated circuit components.

It is an aspect of the present invention to provide an enhanced normalized temperature coefficient voltage regulator capable of offsetting the large positive voltage temperature coefficient normally associated with high voltage avalanche breakdown diodes.

Yet another aspect of the present invention is to provide secondary protection for electronic switching systems which is capable of handling pulses of either polarity on tip-to-ring, tip-to-ground, or ring-to-ground, while also handling gate current passing through an included SCR.

Other and further aspects of the present invention will become apparent during the course of the following description and by reference to the accompanying drawings.

BRIEF DESCRIPTION OF THE DRAWINGS

Referring now to the drawings, where like numerals represent like parts in several views.

DETAILED DESCRIPTION

Figure 1:
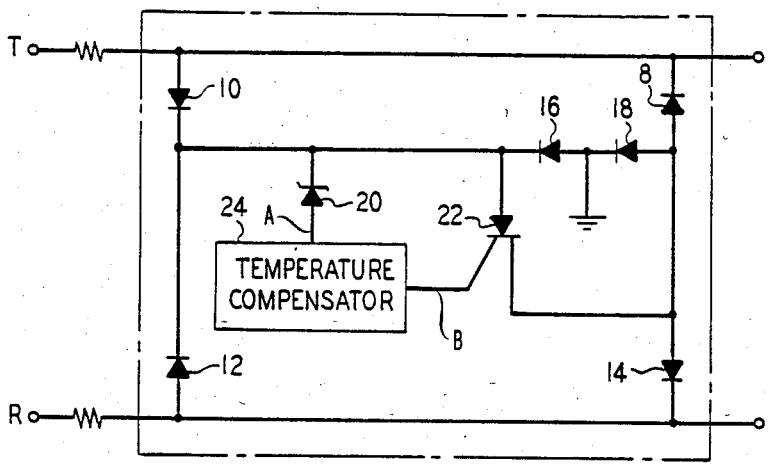
FIG. 1 illustrates a secondary protection scheme for an electronic switching system which includes a temperature compensated integrated circuit formed in accordance with the present invention.

A secondary protection scheme for an electronic switching system which utilizes a temperature compensator formed in accordance with the present invention is illustrated in FIG. 1. As shown, the protection arrangement comprises a plurality of steering diodes 8, 10, 12, 14, 16, and 18, a VR diode 20, an SCR 22 and a temperature compensator 24. Steering diodes 8, 10, 12, 14, 16, and 18 enable a single protector to handle pulses of either polarity on tip-to-ring, tip-to-ground, or ring-to-ground. VR diode 20 and temperature compensator 24 function to set the voltage at which SCR 22 will begin to conduct. VR diode 20 and temperature compensator 24 must also be able to handle the gate current into SCR 22 before it begins to conduct. On transients such as a 10×1000 lightning surge, the gate current could be more than 300 mA.

In an exemplary arrangement, VR diode 20 comprises a breakdown voltage between 202 volts and 227 volts at a temperature of 25 degrees Centigrade, where this breakdown voltage has been found to vary with temperature by approximately +250 mV/degree Centigrade, which represents a normalized temperature coefficient of approximately 0.12% per degree Centigrade. In accordance with the protection arrangement illustrated in FIG. 1, the maximum voltage across the secondary protector must remain in a window of 245–250 volts through the temperature range of 0–85 degrees Centigrade in order to protect the semiconductor switching system. Therefore, to compensate for the positive voltage increase attributed to VR diode 20, the peak voltage of temperature compensator 24 must vary by approximately −250 mV/degree Centigrade. The negative temperature compensation is achieved in accordance with the present invention by the interaction of a resistor network and a transistor base-emitter voltage which has a negative temperature coefficient. Also, the peak voltage related to temperature compensator 24 must be adjustable to be able to match the voltage variations associated with various VR diodes.

Figure 2:
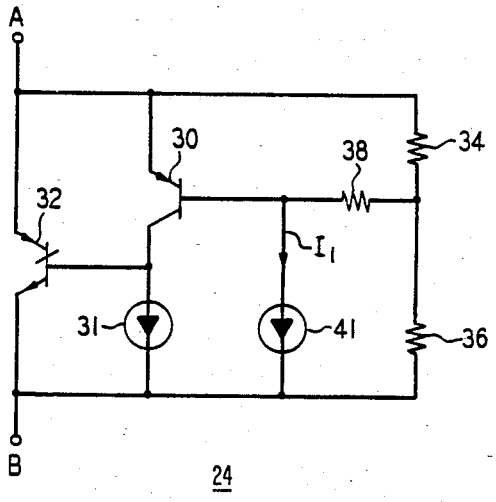
FIG. 2 illustrates a simplified schematic diagram of a temperature compensator formed in accordance with the present invention.

A simplified schematic diagram of a temperature compensator 24 formed in accordance with the present invention which is capable of providing a −250 mV/degree Centigrade negative temperature coefficient and also comprises an adjustable peak voltage, is illustrated in FIG. 2. The threshold voltage for the circuit is determined by the circuit condition which causes a transistor 30 to conduct 75 μA, since this is the condition necessary to turn on a PNPN circuit 32 in association with the presence of a current source 31. In most integrated circuit processes the variation of a base to emitter voltage ($V_{BE}$) of integratable bipolar silicon transistors for a particular collector current with temperature is approximately −2 mV/degree Centigrade, for a base to emitter voltage of approximately 600 mV. This variation represents a temperature coefficient of −0.33%/degree Centigrade. Using a simple voltage divider arrangement as illustrated by resistors 34 and 36 in FIG. 2 (assuming resistor 38 and current source 41 are equal to zero) the threshold voltage for a compensator circuit of this configuration could be approximately 30 V with conventional bipolar SIC technology. Therefore, the resulting threshold voltage temperature variation would be −0.0033×30 V=−0.1 V/degree Centigrade. This is approximately four-tenths of the temperature variation necessary to compensate the 215 V silicon avalanche voltage regulator diode which is representative of many high voltage circuit arrangements, as represented by VR diode 20 of FIG. 1.

Therefore, in accordance with the present invention, enhancement of the threshold voltage temperature coefficient is achieved through the addition of a current source 41 and a resistor 38. The constant current $I_1$ flows through resistor 38, thereby causing a constant voltage drop across resistor 38, independent of temperature. This reduces to about 240 mV the value of the voltage appearing across resistor 34 which corresponds to the threshold voltage point for the base to emitter voltage of transistor 30. Since the voltage drop across resistor 38 does not change with temperature, the voltage variation across resistor 34 is still approximately −2 mV/degree Centigrade, which in this configuration of the present invention, represents a temperature coefficient of −2 mV/240 mV=−0.83%/degree Centigrade. The circuit threshold voltage may again be made equal to 30 V with the proper selection of the value of resistor 36, where the resulting threshold variation with temperature is −0.0083×30=−0.25 V/degree Centigrade, which is the desired temperature variation to compensate a 215 V silicon avalanche voltage regulator diode.

In accordance with the present invention, the equation for the circuit threshold (the voltage at which transistor 30 begins to conduct) for the arrangement illustrated in FIG. 2 is:

$$V_T(T) = (V_{BE}(T) - I_1R_{38})\frac{R_{34}+R_{36}}{R_{34}} \quad (1)$$

$$= V_{BE}(T)\frac{R_{34}+R_{36}}{R_{34}} - I_1R_{38}\frac{R_{34}+R_{36}}{R_{34}}$$

Since only $V_{BE}(T)$ is a function of temperature, it is seen that adjustment of either $I_1$ or resistor 38 will vary the circuit threshold without changing the variation of the threshold voltage with temperature. This independent adjustment capability is important to the manufacturer of a close tolerance temperature compensator diode.

Figure 3:
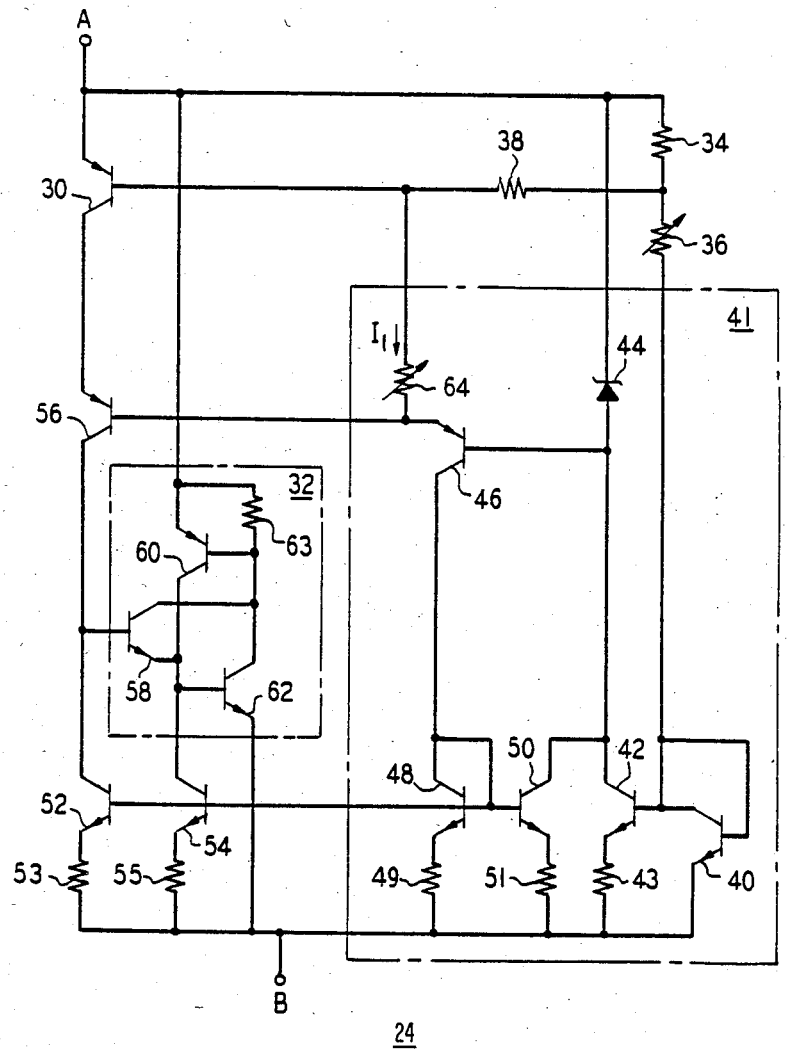
FIG. 3 illustrates a detailed circuit arrangement of temperature compensator formed in accordance with the present invention.

FIG. 3 illustrates a detailed circuit diagram of a temperature compensator circuit formed in accordance with the present invention. Under slow transient conditions (an input pulse with a rise time of less than 10 V/μs), current to temperature compensator 24 increases as VR diode 20 of FIG. 1 breaks down. This current is applied as an input at terminal A, flows through resistors 34 and 36, and is subsequently applied as an input to a transistor 40, causing a voltage drop across diode connected transistor 40. The collector and base of transistor 40 are coupled to the base of a transistor 42, where the voltage drop across transistor 40 causes a current to begin to flow through transistor 42. The collector of transistor 42 is coupled to a Zener diode 44, as shown in FIG. 3, where diode 44 begins to break down as current begins to flow through transistor 42. Diode 44 is also coupled to the base of a transistor 46, causing current to begin to flow through transistor 46 as the voltage across diode 44 increases. The collector of transistor 46 is coupled to the base and collector inputs of a transistor 48 and also to the base input of a transistor 50, where the collector of transistor 50 is coupled to the collector of transistor 42 and functions to supplement the current flow through diode 44. As shown in FIG. 3, the emitters of both transistors 48 and 50 are coupled to the output port B of temperature compensator 24 via a pair of resistors 49 and 51, respectively.

The base inputs of transistors 48 and 50 are connected together and are also connected to the base inputs of a pair of transistors 52 and 54, where the emitters of transistors 52 and 54 are connected by resistors 53 and 55, respectively, to the output port B of the circuit. The collector of transistor 30 is coupled, via a transistor 56, to the collector of transistor 52. The collector of transistor 52 is also coupled to PNPN circuit 32, more particularly, to the base input of a transistor 58 included in PNPN circuit 32. The collector of transistor 54 is also coupled to PNPN circuit 32, in particular, to the collector of a transistor 60, the base of transistor 62, and the emitter of transistor 58 and as illustrated in FIG. 3, PNPN circuit 32 also comprises a transistor 62 and a resistor 63, where the base of transistor 62 is coupled to the emitter of transistor 58, the collectors of transistors 54 and 60, and the collector of transistor 62 is connected to the collector of transistor 58, the base of transistor 60, and resistor 63. As shown, resistor 63 is also coupled to the emitter of transistor 60, where the emitter of transistor 60 is coupled to the input port A of the circuit of FIG. 3.

In accordance with the present invention, the emitter of transistor 48 is approximately twice the size of the emitters of transistors 52 and 54 and resistors 53 and 55 are approximately twice the size of resistor 49. Therefore, the unsaturated current flowing through transistors 52 and 54 will be approximately half that flowing through transistor 48. At the initiation of the operation of the circuit of FIG. 3, the current flowing through transistor 30 and transistor 56 is minimal and, therefore, the current flowing into the bases of transistors 52 and 54 is sufficient to keep them in saturation, thus also keeping transistors 58, 60 and 62 in an off (non-conducting) state.

During the operation of the circuit of the present invention, the current through resistors 34 and 36 will continue to increase, causing the voltage across the base-emitter junction of input transistor 30 to increase. As the voltage reaches its threshold value the voltage across transistor 30 becomes sufficient to provide enough current to bring transistor 52 out of saturation. Transistor 52, upon being activated, functions to allow transistor 58 to be turned on, which in turn activates transistor 62. Any additional current into the input port A of the circuit illustrated in FIG. 3, up to approximately 7.5 mA, will flow through transistor 62, causing the voltage that appears between the input and output ports to remain constant. As the current into the circuit begins to exceed 7.5 mA, the voltage across resistor 63 becomes sufficient to turn on transistor 60. The activation of both transistors 60 and 62 functions to keep the voltage between the input and output terminals less than 2 V.

In the preferred embodiment, Zener diode 44 has a breakdown voltage $BV_{44}$ of approximately 6.3 V with a small positive temperature coefficient. The circuit path determining the current $I_1$ through resistor 64 includes the base-emitter voltage drops of transistors 46 and 30, and the voltage drop across resistor 64. Thus, the current $I_1$ can be expressed as:

$$I_1 = \frac{BV_{44} - VBE_{30} - VBE_{46}}{R_{64}} \quad (2)$$

Since $BV_{44} \cong 6.3$ V with a small positive temperature coefficient and at threshold $VBE_{30}$ and $VBE_{46} \cong 0.65$ V with small negative temperature coefficients, the equation for $I_1$ at threshold reduces to:

$$I_1 \cong 5/R_{64} \quad (3)$$

and equation (1) becomes:

$$VT(T) \cong VBE(T)\frac{R_{34} + R_{36}}{R_{34}} - \frac{5R_{38}(R_{34} + R_{36})}{R_{64}R_{34}} \quad (4)$$

Since resistor 34 is small compared to resistor 36, this equation can be further reduced to:

$$VT(T) \cong VBE(T)\frac{R_{36}}{R_{34}} - \frac{5R_{38}R_{36}}{R_{64}R_{34}} \quad (5)$$

As can be seen from equation (5), the circuit threshold voltage variation with temperature can be controlled during manufacture by trimming resistor 36 and the value of the circuit threshold can be controlled by subsequently trimming resistor 64.

What is claimed is:

1. A temperature compensation circuit for increasing the inherent negative temperature coefficient associated with a bipolar junction transistor (30), said compensation circuit comprising a first resistor (38) connected to the base of said bipolar junction transistor;

a second resistor (34) connected between said first resistor and the emitter of said bipolar junction transistor;

a third resistor (36) connected between said second resistor and a predetermined reference potential; and a current source (41) connected to the base of said bipolar junction transistor for providing a voltage across said first resistor which increases the normalized negative temperature coefficient of the voltage at the junction of said second and third resistors to a value above that of the base to emitter voltage of said bipolar junction transistor.

2. A temperature compensation circuit formed in accordance with claim 1 wherein the constant current source (41) comprises an emitter-follower transistor (46) having its collector connected to a negative potential;

a resistor (64) connected between the emitter of said emitter follower transistor (46) and the base of the bipolar junction transistor (30);

a Zener diode (44) connected between the base of said emitter follower transistor (46) and the input terminal; and a second current source for biasing the Zener diode connected to the base of said emitter follower transistor.

3. A temperature compensation circuit formed in accordance with claim 2 wherein the second current source which biases the Zener diode (44) comprises a first transistor (48) having both its collector and base terminals connected to the collector of the emitter follower transistor (46);

a fourth resistor (49) connected between the emitter of said first transistor (48) and said predetermined reference potential;

a second transistor (50) having its base connected to the base of the first transistor (48) and its collector connected to the base of the emitter follower transistor;

a fifth resistor (51) connected between the emitter of the second transistor (50) and said predetermined reference potential;

a third current source for starting the second current source coupled between the base of the emitter follower transistor (46) and said predetermined reference potential.

4. A temperature compensation circuit formed in accordance with claim 3 wherein the third current source which starts the second current source comprises a third transistor (40) having both its base and collector terminals connected to the third resistor (36) and its emitter connected to said predetermined reference potential;

a fourth transistor (42) having its base connected to said base of said third transistor (40) and its collector connected to the base of the emitter follower transistor (46).

5. A temperature compensation circuit comprising a first device (20) having a positive temperture coefficient, yielding a positive voltage variation with temperature;

a bipolar junction transistor (30) coupled to the output of said first device, said bipolar junction transistor having a negative temperature coefficient, yielding a negative voltage variation with temperature of lesser magnitude than said positive voltage variation of said first device; and enhanced negative temperature compensation means (34,36,38,41) coupled to both said bipolar junction transistor and said first device for increasing the inherent negative temperature coefficient of said bipolar junction transistor and providing an overall zero temperature coefficient in said temperature compensation circuit, wherein said enhanced negative temperature compensation means comprises a first resistor (38) connected to the base of the bipolar junction transistor;

a second resistor (34) connected between said first resistor and the emitter of said bipolar junction transistor;

a third resistor (36) connected between said second resistor and a predetermined reference potential; and a constant current source (41) coupled between the base of said bipolar junction transistor and said predetermined reference potential for providing a constant voltage across said first resistor which increases the normalized negative temperature coefficient of the voltage at the junction of said second and third resistors to a value above that of the base to emitter voltage of said bipolar junction transistor.

6. A temperature compensation circuit formed in accordance with claim 5 wherein the first device comprises a high voltage avalanche diode.

7. A temperature compensation circuit for providing an enhanced negative temperature coefficient, said circuit comprising an input terminal (A) for receiving an input current;

a first transistor (30) having its emitter connected to said input terminal wherein the base-to-emitter voltage of said first transistor decreases at a first predetermined normalized rate as the temperature of said temperature compensation circuit increases;

an output terminal (B);

a voltage divider network (34 and 36), including an internal divider node, connected between said input terminal and said output terminal; and means for controlling the voltage at said internal divider node of said voltage divider network such that said voltage is held constant for an increasing input current, wherein the controlling of said internal divider node voltage results in decreasing its voltage with respect to the input terminal at a second normalized rate greater than said first predetermined normalized rate as the temperature of said temperature compensation circuit increases.

8. A temperature compensation circuit formed in accordance with claim 7 wherein the voltage controlling means with respect to temperature includes a resistor coupled between the base of the first transistor and the internal divider node of the voltage divider network; and a current source (41) coupled between said base of said first transistor and the output terminal for controlling the voltage appearing across said resistor and providing a negative temperature coefficient voltage regulation between said input voltage and a voltage appearing at said output terminal.

9. A temperature compensation circuit formed in accordance with claim 7 wherein the voltage controlling means with respect to current includes a coupling means (38) between the base of the first transistor and the internal divider node of the voltage divider network; and a current source (31) connected between said output terminal and the collector of said first transistor;

a PNPN circuit (32) comprising a first and a second PNPN emitter and a base, said PNPN base connected to the collector of said first transistor, said first emitter connected to said input terminal and said second emitter connected to said output terminal.

10. A temperature compensation circuit formed in accordance with claim 9 wherein the PNPN circuit comprises a second transistor having its base input connected to the collector of the first transistor of the compensation circuit as the base of the PNPN circuit;

a third transistor having its base coupled to the emitter of the first transistor, its emitter coupled to the output terminal, and its collector coupled to the collector of said first transistor;

a fourth transistor having its base coupled to the collector of said second transistor and its emitter coupled to the input terminal; and a resistor coupled between the emitter of said third transistor and the collector of said second transistor.

11. A temperature compensation circuit formed in accordance with claim 10 wherein the current source (31) of said temperature compensation circuit comprises a fifth transistor having its associated collector coupled to the base of the first transistor of the PNPN circuit;

a sixth transistor having its associated collector coupled to the base of the second transistor of said PNPN circuit;

a first resistor coupled between the emitter of said first transistor and the output terminal; and a second resistor coupled between the emitter of said second transistor and said output terminal.

* * * * *